US011417937B2

(12) United States Patent
Li et al.

(10) Patent No.: US 11,417,937 B2
(45) Date of Patent: Aug. 16, 2022

(54) PHASE SHIFTER TRANSMISSION DEVICE

(71) Applicants: ROSENBERGER TECHNOLOGIES CO., LTD., Suzhou (CN); Rosenberger Technologies LLC, Budd Lake, NJ (US)

(72) Inventors: Yongzhong Li, Suzhou (CN); Xu Wang, Suzhou (CN); Ke Zhou, Suzhou (CN); Zhonghao Zou, Suzhou (CN); Jing Sun, Suzhou (CN); Fan Li, Suzhou (CN)

(73) Assignees: ROSENBERGER TECHNOLOGIES CO., LTD., Suzhou (CN); ROSENBERGER TECHNOLOGIES LLC, Budd Lake, NJ (US)

( * ) Notice: Subject to any disclaimer, the term of this patent is extended or adjusted under 35 U.S.C. 154(b) by 0 days.

(21) Appl. No.: 17/505,021

(22) Filed: Oct. 19, 2021

(65) Prior Publication Data

US 2022/0037783 A1 Feb. 3, 2022

Related U.S. Application Data

(63) Continuation of application No. PCT/CN2019/126452, filed on Dec. 19, 2019.

(30) Foreign Application Priority Data

Dec. 12, 2019 (CN) ..... 201911274537.6

(51) Int. Cl.

| | |
|---|---|
| ***H01P 1/18*** | (2006.01) |
| ***H01Q 3/32*** | (2006.01) |
| ***H01Q 1/24*** | (2006.01) |

(52) U.S. Cl.

CPC ..... *H01P 1/184* (2013.01); *H01P 1/18* (2013.01); *H01Q 1/243* (2013.01); *H01Q 3/32* (2013.01)

(58) Field of Classification Search

CPC .. H01Q 3/32; H01Q 3/243; H01P 1/18; H01P 1/184

(Continued)

(56) References Cited

U.S. PATENT DOCUMENTS

2016/0276745 A1* 9/2016 Fleancu ..... H01Q 3/04

FOREIGN PATENT DOCUMENTS

| | | | |
|---|---|---|---|
| CN | 101521312 | A | 9/2009 |
| CN | 201853811 | U | 6/2011 |

(Continued)

OTHER PUBLICATIONS

The World Intellectual Property Organization (WIPO) International Search Report for PCT/CN2019/126452 dated Sep. 23, 2020 6 Pages (including translation).

*Primary Examiner* — Rakesh B Patel
*Assistant Examiner* — Jorge L Salazar, Jr.
(74) *Attorney, Agent, or Firm* — Anova Law Group, PLLC

(57) ABSTRACT

A phase shifter transmission device includes: a power mechanism, a driving rod, a plurality of transmission assemblies, and at least one row of phase shifters. The power mechanism is connected to the driving rod and configured to drive the driving rod to rotate. The plurality of transmission assemblies are connected to the driving rod, distributed along an axial direction of the driving rod, and driven by the driving rod to rotate synchronously. Each row of phase shifters includes a plurality of phase shifters distributed along the axial direction of the driving rod, and each phase shifter of each row of phase shifters is connected to the corresponding transmission assembly. The at least one row of phase shifters are configured, when being driven by the (Continued)

plurality of transmission assemblies, to synchronously adjust phases of radiated signals corresponding to the phase shifters.

16 Claims, 7 Drawing Sheets

(58) Field of Classification Search
USPC ..... 333/24 R, 139, 156, 161
See application file for complete search history.

(56) References Cited

FOREIGN PATENT DOCUMENTS

| | | | |
|---|---|---|---|
| CN | 103855471 | A | 6/2014 |
| CN | 104810619 | A | 7/2015 |
| CN | 207559071 | U | 6/2018 |
| KR | 20100117838 | A | 11/2010 |

* cited by examiner

PHASE SHIFTER TRANSMISSION DEVICE

CROSS-REFERENCES TO RELATED APPLICATIONS

This application is a continuation application of PCT application PCT/CN2019/126452, filed on Dec. 19, 2019, which claim priority to Chinese Patent Application No. CN 201911274537.6, filed Dec. 12, 2019, the entire content of which is incorporated herein by reference.

TECHNICAL FIELD

The present disclosure relates to a transmission device in a mobile communication antenna and, more particularly, to a phase shifter transmission device.

BACKGROUND

Radiation angle of a mobile communication antenna needs to be adjusted according to change of main source of the antenna by the way of driving a phase shifter in the antenna through a transmission device. Traditional transmission device of the phase shifter is one or more motor drive devices to drive a single or multiple phase shifters through adapters such as pull rods, which changes phase of the phase shifter of a base station antenna in a mobile communication system, and realizes electric down tilt adjustment control of the antenna.

However, there are the following two issues in the above solution: 1, an excessive number of electrically adjustable antenna driver motors increases difficulties of consistency and synchronization. 2, application of the adapters such as the pull rods affects accuracy of the phase shifter. Under high requirements of amplitude and phase of 5G large-matrix multi-channel antennas, it is more difficult to meet requirements of amplitude and phase consistency and high accuracy of the antenna by using the traditional driving method described above.

SUMMARY

In accordance with the disclosure, there is provided a phase shifter transmission device, including: a power mechanism, a driving rod, a plurality of transmission assemblies, and at least one row of phase shifters. The power mechanism is connected to the driving rod and configured to drive the driving rod to rotate. The plurality of transmission assemblies are connected to the driving rod, distributed along an axial direction of the driving rod, and driven by the driving rod to rotate synchronously. Each row of phase shifters includes a plurality of phase shifters distributed along the axial direction of the driving rod, and each phase shifter of each row of phase shifters is connected to the corresponding transmission assembly. The at least one row of phase shifters are configured, when being driven by the plurality of transmission assemblies, to synchronously adjust phases of radiated signals corresponding to the phase shifters.

Figure 1:
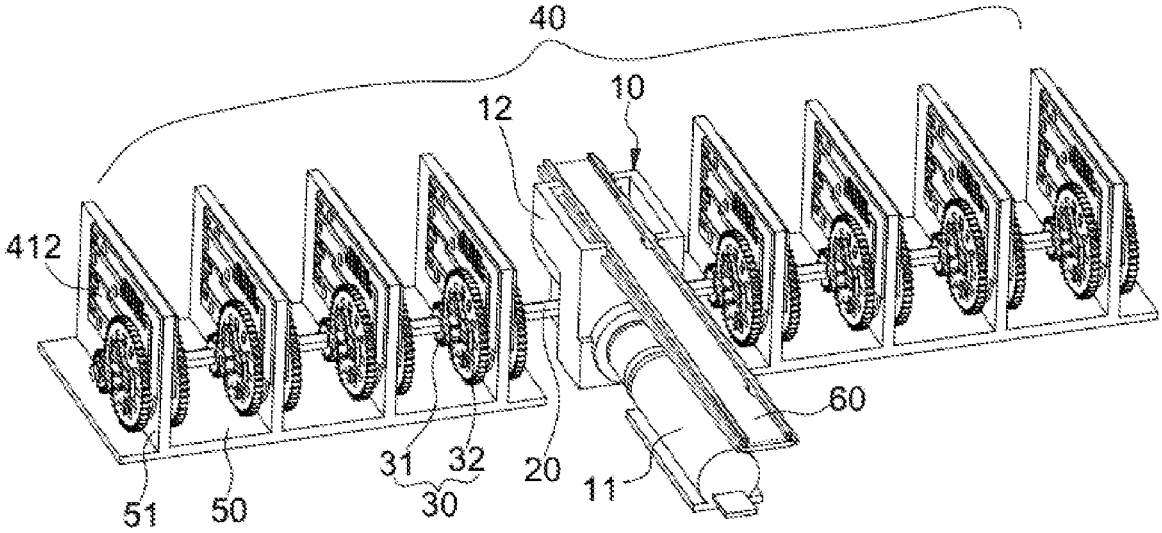
FIG. 1 is a perspective view showing a transmission device for a row of phase shifters according to an embodiment of the present disclosure.
Figure 2:
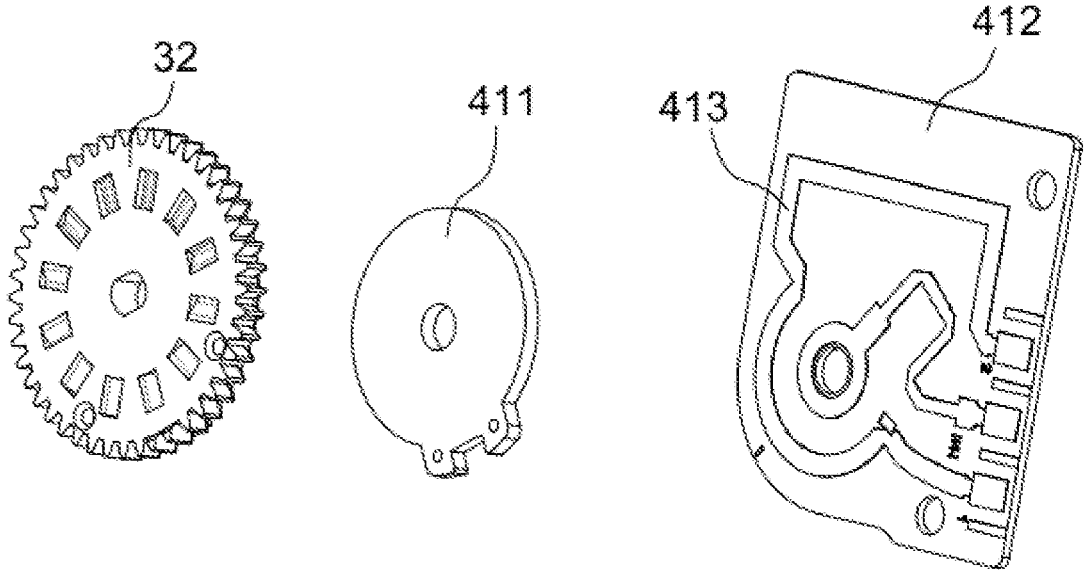
FIG. 2 is an exploded view of a phase shifter and a driven gear according to an embodiment of the present disclosure.
Figure 3:
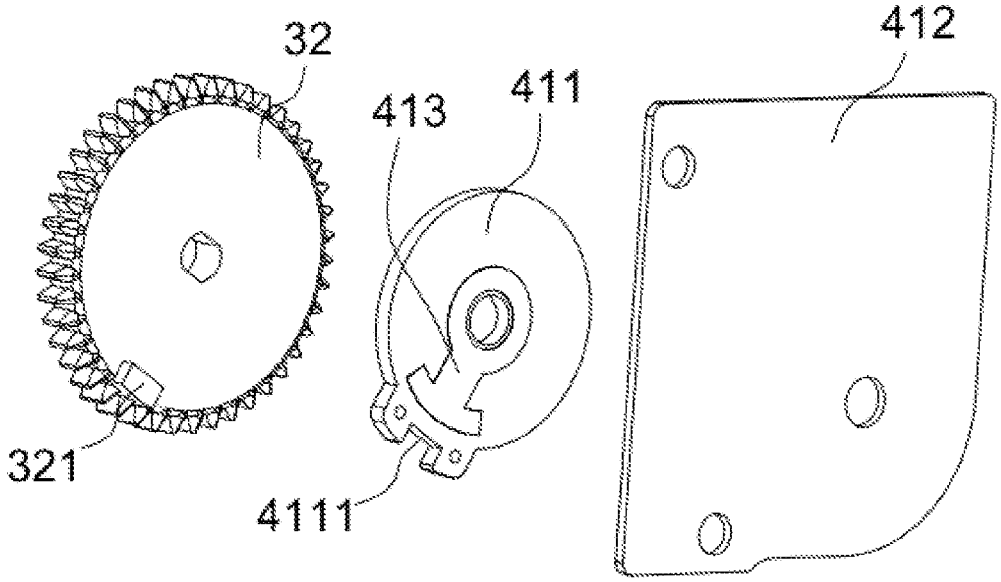
FIG. 3 is an exploded view of FIG. 2 from another perspective.
Figure 4:
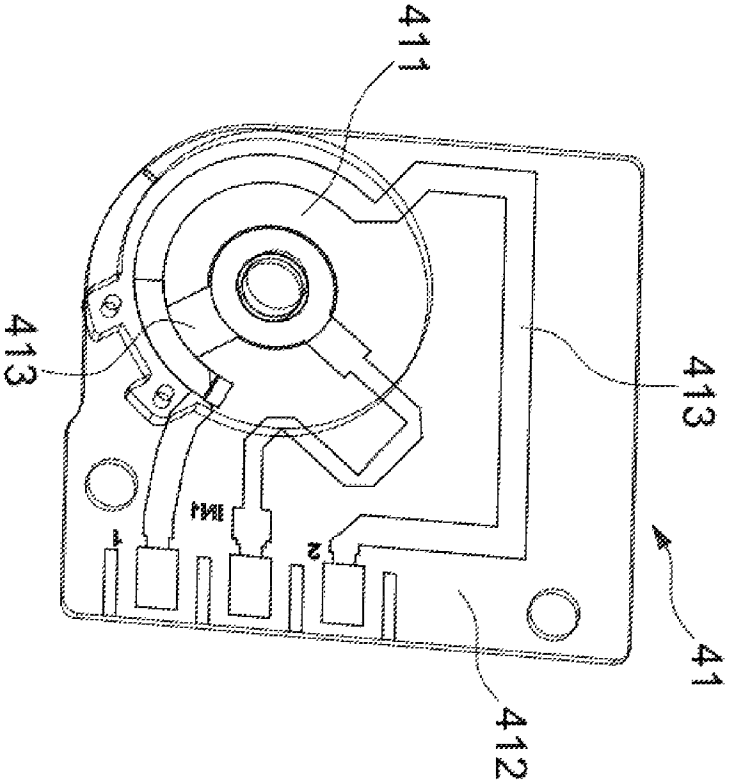
FIG. 4 is a cross-sectional structure of a phase shifter according to an embodiment of the present disclosure.
Figure 5:
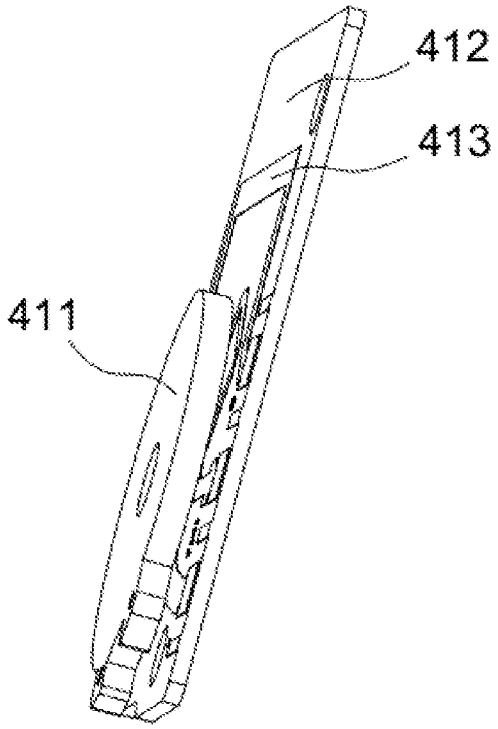
FIG. 5 is a perspective view of an assembled phase shifter according to an embodiment of the present disclosure.

Reference Numerals:

Power mechanism 10, Motor 11, Gear box 12, Driving rod 20, Transmission assembly 30, Driving gear 31, Driven gear 32, Clamping block 321, One-row phase shifters 40, Phase shifter 41, First PCB board 411, Slot 4111, Second PCB board 412, Line 413, Base 50, Fixing plate 51, Rack 60.

DETAILED DESCRIPTION OF THE EMBODIMENTS

The technical solutions of the embodiments of the present disclosure will be clearly described in detail below in conjunction with the accompanying drawings of the present disclosure.

A phase shifter transmission device disclosed in the present disclosure drives multiple phase shifters through fewer motors (one or more motors), and adjusts phases of the multiple phase shifters synchronously, which solves difference among the multiple phase shifters, ensures amplitude and phase consistency, and solves the issue that adapters such as pull rods affect accuracy of the phase shifter, etc.

As shown in FIG. 1, a phase shifter transmission device disclosed in some embodiments of the present disclosure includes a power mechanism 10, a driving rod 20, a plurality of transmission assemblies 30, and one-row phase shifters 40 (i.e., phase shifters arranged in one row). The power mechanism 10 is connected to the driving rod 20 to drive the driving rod 20 to rotate, and the driving rod 20 is connected to the plurality of transmission assemblies 30. The plurality of transmission assemblies 30 are connected to the one-row phase shifters 40, and the one-row phase shifters 40 are driven by the driving rod 20 to synchronously adjust the phases of radiated signals corresponding to the phase shifters in the same direction.

Specifically, the power mechanism 10 includes a motor 11 and a gear assembly (not shown in figures), and the motor 11 is connected to the gear assembly. The gear assembly is connected to the driving rod 20, and is driven by the motor 11 to drive the driving rod 20 to rotate. In some embodiments, the gear assembly is arranged inside a gear box 12 and the motor 11 is located outside the gear box 12.

In some embodiments, two ends of the driving rod 20 pass through the gear box 12. In some other embodiments, only one end of the driving rod 20 may pass through the gear box 12.

One driving rod 20 is connected to the plurality of transmission assemblies 30, and the plurality of transmission assemblies 30 are distributed along an axial direction of the driving rod 20 and are driven by the driving rod 20 to rotate synchronously. In some embodiments, each transmission assembly 30 includes a driving gear 31 (also referred as a rod connection gear) and a driven gear 32 (also referred as a phase-shifter connection gear), where the driving gear 31 is fixed to the driving rod 20 and rotates synchronously with the driving rod 20, and the driven gear 32 is engaged with the driving gear 31 and rotates in an opposite direction while the driving gear 31 rotates. In some embodiments, all driving gears 31 of the transmission assemblies 30 may have the same size, and all driven gears 32 of the transmission assemblies 30 may have the same size and are larger than the driving gears 31.

In some embodiments, one row of phase shifters 41 is provided, which is a single row of phase shifters. The row of phase shifters 41 includes a plurality of phase shifters 41 distributed along the axial direction of the driving rod 20, and each phase shifter 41 is correspondingly connected to a transmission assembly 30, that is, each phase shifter 41 is adjusted in phase by one corresponding transmission assembly 30. Since the driving rod 20 may pass through the gear box 12 at only one side or both sides when implemented, the plurality of transmission assemblies 30 may be distributed at the same side or both sides of the gear box 12 when distributed along the driving rod 20, so that the one-row phase shifters 40 may be distributed at the same side or both sides of the gear box 12 when implemented, which are all driven by a driving rod 20.

Specifically, referring to FIGS. 2-5, in some embodiments, each phase shifter 41 includes a first PCB board 411 and a second PCB board 412 that are coupled to each other, and the first PCB board 411 is fixedly connected to the driven gear 32 of the transmission assembly 30, that is, the first PCB board 411 rotates synchronously with rotation of the driven gear 32. Specifically, in some embodiments, a protruding clamping block 321 is provided at an inner side of the driven gear 32, and the clamping block 321 is specifically arranged close to an outer edge of the driven gear 32. A slot 4111 that matches with the clamping block 321 is provided at the first PCB board 411, and the slot 4111 is specifically arranged at an outer edge of the first PCB board 411. The clamping block 321 of the driven gear 32 is clamped into the slot 4111 of the first PCB board 411 to achieve a fixed connection between the first PCB board 411 and the driven gear 32.

Both the first PCB board 411 and the second PCB board 412 are provided with corresponding lines 413. In some embodiments, the second PCB board 412 has two lines with one input and two outputs, but in some other embodiments, it is not limited to this circuit structure, such as lines with one input and multiple outputs.

The phase shifter transmission device also includes a base 50, and the base 50 is provided with a plurality of fixing plates 51. In some embodiments, the base 50 is horizontally arranged, and each fixing plate 51 extends vertically upward from an upper end surface of the base 50, that is, each fixing plate 51 is vertically arranged. In some other embodiments, the positional relationship between the base 50 and the fixing plate 51 is not limited to the vertical relationship defined here. Also, the base 50 may not be provided in some other embodiments, where the fixing plate 51 is directly connected to a reflective plate (not shown in figures).

The plurality of fixing plates 51 are also distributed along the axial direction of the driving rod 20, and the driving rod 20 passes through the fixing plate 51. The second PCB board 412 of each phase shifter described above is fixed to the fixing plate 51, that is, the second PCB board 412 is stationary. When implemented, a second PCB board 412 is fixed at either side (a surface on which this side is located is perpendicular to an extension direction of the driving rod 20) or both sides of each fixing plate 51. In some embodiments, a second PCB board 412 is fixed at each side of each fixing plate 51, that is, each fixing plate 51 corresponds to two phase shifters 41 and two transmission assemblies 30.

In some embodiments, the phase shifter transmission device also includes a rack 60 connected to the gear assembly. The rack 60 directly restricts a rotation range of the gear assembly to restrict a rotation range of the transmission assembly 30, and ultimately prevents a phase range adjustment of the phase shifter from exceeding a preset range, which can play a role in mechanical protection. In addition, the rack also plays a role in zeroing phase of the phase shifter. In some embodiments, the rack 60 is arranged at a top end of the gear box 12, and its extension direction is perpendicular to the extension direction of the driving rod 20. In some other embodiments, the rack 60 can also be arranged at a bottom end of the gear box 12.

The working principle of the above embodiments is as below. The motor 11 drives the driving rod 20 to rotate through the gear assembly, and the driving rod 20 drives the plurality of transmission assemblies 30 connected thereto to rotate synchronously while rotating. Each transmission assembly 30 drives the first PCB board 411 connected thereto to rotate while rotating, and rotation of the first PCB board 411 causes coupling position of the first PCB board 411 and the second PCB board 412 to change, so that the phase shifter 41 changes the phase. Therefore, in the above embodiments, it is finally realized that one motor 11 drives the one-row phase shifters 40 to synchronously change the phases in the same direction.

Figure 6:
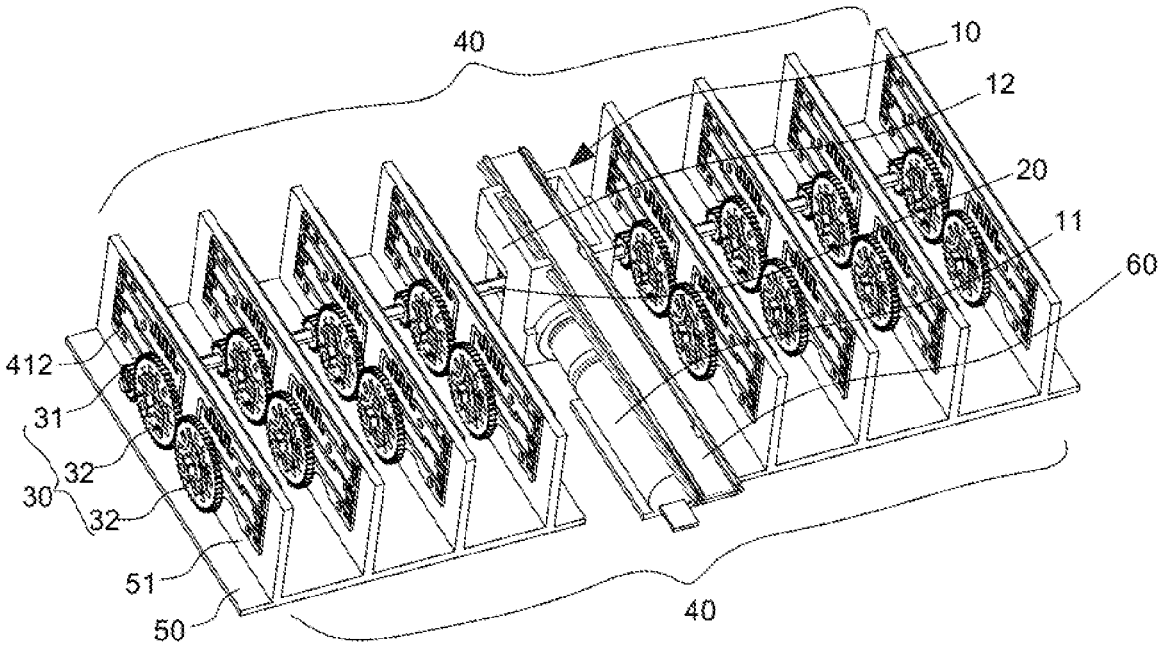
FIG. 6 is a perspective view showing a transmission device for two rows of phase shifters according to another embodiment of the present disclosure.

As shown in FIG. 6, a phase shifter transmission device disclosed in some embodiments of the present disclosure includes the power mechanism 10, the driving rod 20, a plurality of transmission assemblies 30, and two-row phase shifters. The power mechanism 10 is connected to the driving rod 20 to drive the driving rod 20 to rotate, and the driving rod 20 is connected to the plurality of transmission assemblies 30. The plurality of transmission assemblies 30 are connected to the two-row phase shifters, and the two-row phase shifters are driven by the driving rod 20 to synchronously adjust the phases in the opposite direction.

Specifically, the power mechanism 10 includes a motor 11 and the gear assembly (not shown in figures), and the motor 11 is connected to the gear assembly. The gear assembly is connected to the driving rod 20, and driven by the motor 11 to drive the driving rod 20 to rotate. In some embodiments, the gear assembly is arranged inside the gear box 12 and the motor 11 is located outside the gear box 12. In some other embodiments, the number of motors is not limited to one, and multiple motors can be provided. For example, each motor drives a row of phase shifters correspondingly.

In some embodiments, the two ends of the driving rod 20 passes through the gear box 12. In some other embodiments, the only one end of the driving rod 20 may also pass through the gear box 12.

A driving rod 20 is connected to the plurality of transmission assemblies 30, and the plurality of transmission assemblies 30 are distributed along the axial direction of the driving rod 20 and driven by the driving rod 20 to rotate synchronously. In some embodiments, each transmission assembly 30 includes one driving gear 31 and two driven gears 32, and the driving gear 31 is fixed to the driving rod 20 and rotates synchronously with the driving rod 20. The two driven gears 32 are located at the same side of the driving gear 31 and engaged with each other, and one of the two driven gears 32 is engaged with the driving gear 31, so that the two driven gears 32 are driven by the driving gear 31 to rotate in opposite directions while the driving gear 31 rotates.

In some embodiments, there are two rows of phase shifters 41, i.e., multiple rows of phase shifters. Each row of phase shifters 41 includes a plurality of phase shifters 41 distributed along the axial direction of the driving rod 20, that is, the phase shifters 41 of each row of phase shifters are arranged in the same direction as the extension direction of the driving rod 20. Also, two adjacent phase shifters 41 in corresponding positions of the two-row phase shifters are located or approximately located in the same column, where a column direction is a direction perpendicular to the direction of the driving rod 20.

Each phase shifter 41 is correspondingly connected to one of the driven gears 32 in one transmission assembly 30, that is, one transmission assembly 30 adjusts the phases of the two phase shifters 41 at the same time. In some embodiments, two driven gears 32 of one transmission assembly 30 are respectively connected to two phase shifters 41 located or approximately located in the same column in the two-row phase shifters. In one embodiment, the driving rod 20 can pass through the gear box 12 at just one side of the gear box 12, the multiple transmission assemblies 30 can be distributed at the same side of the gear box 12 along the driving rod 20, so that the two-row phase shifters can be distributed at the same side of the gear box 12 and all driven by one driving rod 20. In another embodiment, the driving rod 20 can pass through the gear box 12 at two sides of the gear box 12, the multiple transmission assemblies 30 can be distributed at two sides of the gear box 12 along the driving rod 20, so that the two-row phase shifters can be distributed at two sides of the gear box 12, and all driven by one driving rod 20. In some other embodiments, multiple driving rods 20 may be provided, and the multiple driving rods 20 are configured to drive the phase shifters to synchronously adjust the phases.

Specifically, referring to FIGS. 2-5, in some embodiments, each phase shifter 41 includes the first PCB board 411 and the second PCB board 412 that are coupled to each other, and the first PCB board 411 is fixedly connected to a corresponding driven gear 32 of the transmission assembly 30, that is, the first PCB board 411 rotates synchronously with rotation of the driven gear 32. Specifically, in some embodiments, the protruding clamping block 321 is provided at the inner side of the driven gear 32, and the clamping block 321 is specifically arranged close to the outer edge of the driven gear 32. The slot 4111 that matches with the clamping block 321 is provided at the first PCB board 411, and the slot 4111 is specifically arranged at the outer edge of the first PCB board 411. The clamping block 321 of the driven gear 32 is clamped into the slot 4111 of the first PCB board 411 to achieve a fixed connection between the first PCB board 411 and the driven gear 32.

Both the first PCB board 411 and the second PCB board 412 are provided with the corresponding lines 413. In some embodiments, the second PCB board 412 has two lines with one input and two outputs, but in some other embodiments, it is not limited to this circuit structure, such as lines with one input and multiple outputs.

The phase shifter transmission device also includes the base 50, and the base 50 is provided with a plurality of fixing plates 51. In some embodiments, the base 50 is horizontally arranged, and each fixing plate 51 extends vertically upward from the upper end surface of the base 50, that is, each fixing plate 51 is vertically arranged. In some other embodiments, the positional relationship between the base 50 and the fixing plate 51 is not limited to the vertical relationship defined here. Also, the base 50 may not be provided in some other embodiments, where the fixing plate 51 is directly connected to the reflective plate (not shown in figures).

The plurality of fixing plates 51 are also distributed along the axial direction of the driving rod 20, and the driving rod 20 passes through the fixing plate 51. The second PCB board 412 of each phase shifter 41 is fixed to the fixing plate 51, that is, the second PCB board 412 is stationary. When implemented, two second PCB boards 412 are fixed at either side (a surface on which this side is located is perpendicular to the extension direction of the driving rod 20) or both sides of each fixing plate 51. In some embodiments, two second PCB boards 412 are fixed at both sides of each fixing plate 51, that is, each fixing plate 51 corresponds to four phase shifters 41 and two transmission assemblies 30.

In some embodiments, the phase shifter transmission device also includes the rack 60 connected to the gear assembly. The rack 60 directly restricts the rotation range of the gear assembly to restrict the rotation range of the transmission assembly 30, and ultimately prevents the phase range adjustment of the phase shifter from exceeding the preset range, which can play a role in mechanical protection. In addition, the rack also plays a role in zeroing phase of the phase shifter. In some embodiments, the rack 60 is arranged at the top end of the gear box 12, and its extension direction is perpendicular to the extension direction of the driving rod 20.

The working principle of the above embodiments is as below. The motor 11 drives the driving rod 20 to rotate through the gear assembly, and the driving rod 20 drives the plurality of transmission assemblies 30 connected thereto to rotate synchronously while rotating. The two driven gears 32 of each transmission assembly 30 rotate in opposite directions, and each driven gear 32 drives the first PCB board 411 connected thereto to rotate while rotating. The rotation of the first PCB board 411 causes the coupling position of the first PCB board 411 and the second PCB board 412 to change, so that the phase shifter 41 changes the phase. Therefore, in the above embodiments, it is finally realized that one motor 11 drives the two-row phase shifters to synchronously change the phases in the opposite direction.

In some other embodiments, the phase shifters 41 can also be expanded to three or more rows. Correspondingly, each transmission assembly 30 increases the number of driven gears 32, that is, each transmission assembly 30 includes one driving gear 31 and three or more driven gears 32. The three or more driven gears 32 are located on the same side of the driving gear 31 and neighboring driven gears 32 of the driven gears 32 are engaged with each other, and one of the driven gears 32 is engaged with the driving gear 31. Each driven gear 32 is correspondingly connected to one phase shifter 41, and three or more phase shifters 41 located in or nearly in the same column among the three or more rows of phase shifters are correspondingly connected to one transmission assembly 30, and driven by one transmission assembly 30 at the same time. Also, the first driven gear engaged with the driving gear and a $(2n+1)^{th}$ (such as the third, fifth, etc.) driven gear spaced apart from the first driven gear rotate synchronously in the same direction, thereby driving the phase shifters in the corresponding rows (such as the first row, the third row, . . . , the $(2n+1)^{th}$ row) to synchronously adjust the phases in the same direction. The second driven gear engaged with the first driven gear and a $(2n+2)^{th}$ (such as the fourth, sixth, etc.) driven gear spaced apart from the second driven gear rotate synchronously in the same direction, and rotate synchronously in opposite direction with the first driven gear, thereby driving the phase shifters in the corresponding rows (such as the second row, the fourth row, . . . , the $(2n+2)^{th}$ row) to synchronously adjust the phases in the opposite direction, so that the phase shifter of two adjacent rows (such as the first row and the second row, the third row and the fourth row, etc.) synchronously adjust the phases in the opposite direction, where n is an integer greater than or equal to 1.

Figure 7:
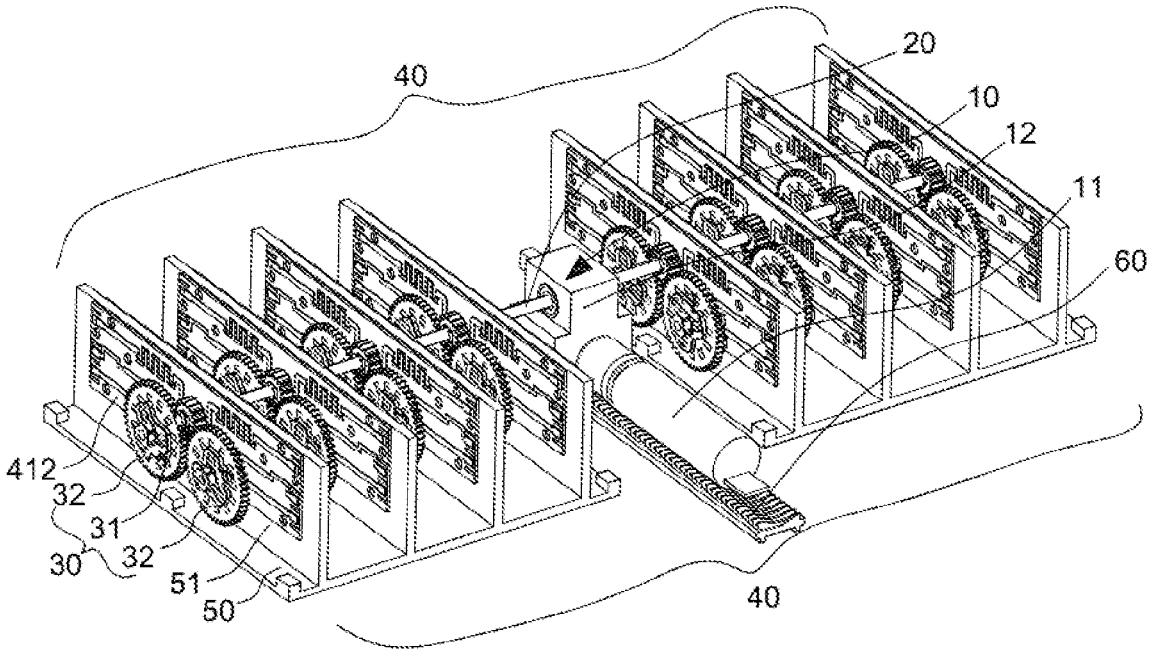
FIG. 7 is a perspective view showing another transmission device for two rows of phase shifters according to another embodiment of the present disclosure.

As shown in FIG. 7, a phase shifter transmission device disclosed in some embodiments of the present disclosure includes the power mechanism 10, the driving rod 20, a plurality of transmission assemblies 30, and the two-row phase shifters. The power mechanism 10 is connected to the driving rod 20 to drive the driving rod 20 to rotate, and the driving rod 20 is connected to the plurality of transmission assemblies 30. The plurality of transmission assemblies 30 are connected to the two-row phase shifters, and the two-row phase shifters are driven by the driving rod 20 to synchronously adjust the phases in the same direction.

Specifically, the power mechanism 10 includes one motor 11 and the gear assembly (not shown in figures), and the motor 11 is connected to the gear assembly. The gear assembly is connected to the driving rod 20, and driven by the motor 11 to drive the driving rod 20 to rotate. In some embodiments, the gear assembly is arranged inside the gear box 12 and the motor 11 is located outside the gear box 12.

In some embodiments, the two ends of the driving rod 20 passes through the gear box 12. In some other embodiments, the only one end of the driving rod 20 may pass through the gear box 12.

A driving rod 20 is connected to the plurality of transmission assemblies 30, and the plurality of transmission assemblies 30 are distributed along the axial direction of the driving rod 20 and driven by the driving rod 20 to rotate synchronously. In some embodiments, each transmission assembly 30 includes a driving gear 31 and two driven gears 32, and the driving gear 31 is fixed to the driving rod 20 and rotates synchronously with the driving rod 20. The two driven gears 32 are respectively located at two sides of the driving gear 31 and both engaged with the driving gear 31, so that the two driven gears 32 are driven by the driving gear 31 to rotate in the same direction while the driving gear 31 rotates.

In some embodiments, there are two rows of phase shifters, i.e., multiple rows of phase shifters. Each row of phase shifters 41 includes a plurality of phase shifters 41 distributed along the axial direction of the driving rod 20, that is, the phase shifters 41 of each row of phase shifters are arranged in the same direction as the extension direction of the driving rod 20. Also, two adjacent phase shifters 41 in corresponding positions of the two-row phase shifters are located or approximately located in the same column, where the column direction is the direction perpendicular to the direction of the driving rod 20.

Each phase shifter 41 is correspondingly connected to one of the driven gears 32 of one transmission assembly 30, that is, the transmission assembly 30 adjusts the phases of the two phase shifters 41 at the same time. In some embodiments, two driven gears 32 of the transmission assembly 30 are respectively connected to two phase shifters 41 located or approximately located in the same column of the two-row phase shifters. In one embodiment, the driving rod 20 can pass through the gear box 12 at one side of the gear box 12, the multiple transmission assemblies 30 can be distributed at the same side of the gear box 12 along the driving rod 20, so that the two-row phase shifters can be distributed at the same side of the gear box 12 and all driven by one driving rod 20. In another embodiment, the driving rod 20 can pass through the gear box 12 at two sides of the gear box 12, the multiple transmission assemblies 30 can be distributed at two sides of the gear box 12 along the driving rod 20, so that the two-row phase shifters can be distributed at two sides of the gear box 12 and all driven by one driving rod 20. In some other embodiments, multiple driving rods 20 may be provided, and the multiple driving rods 20 are configured to drive the phase shifters to synchronously adjust the phases.

Specifically, referring to FIGS. 2-5, in some embodiments, each phase shifter 41 includes the first PCB board 411 and the second PCB board 412 that are coupled to each other, and the first PCB board 411 is fixedly connected to a corresponding driven gear 32 of the transmission assembly 30, that is, the first PCB board 411 rotates synchronously with rotation of the driven gear 32. Specifically, in some embodiments, the protruding clamping block 321 is provided at the inner side of the driven gear 32, and the clamping block 321 is specifically arranged close to the outer edge of the driven gear 32. The slot 4111 that matches with the clamping block 321 is provided at the first PCB board 411, and the slot 4111 is specifically arranged at the outer edge of the first PCB board 411. The clamping block 321 of the driven gear 32 is clamped into the slot 4111 of the first PCB board 411 to achieve a fixed connection between the first PCB board 411 and the driven gear 32.

Both the first PCB board 411 and the second PCB board 412 are provided with the corresponding lines 413. In some embodiments, the second PCB board 412 has two lines with one input and two outputs, but in some other embodiments, it is not limited to this circuit structure, such as lines with one input and multiple outputs.

The phase shifter transmission device also includes the base 50, and the base 50 is provided with a plurality of fixing plates 51. In some embodiments, the base 50 is horizontally arranged, and each fixing plate 51 extends vertically upward from the upper end surface of the base 50, that is, each fixing plate 51 is vertically arranged. In some other embodiments, the positional relationship between the base 50 and the fixing plate 51 is not limited to the vertical relationship defined here. Also, the base 50 may not be provided in some other embodiments, where the fixing plate 51 is directly connected to the reflective plate (not shown in figures).

The plurality of fixing plates 51 are also distributed along the axial direction of the driving rod 20, and the driving rod 20 passes through the fixing plate 51. The second PCB board 412 of each phase shifter 41 is fixed to the fixing plate 51, that is, the second PCB board 412 is stationary. When implemented, two second PCB boards 412 are fixed at either side (a surface on which this side is located is perpendicular to the extension direction of the driving rod 20) or both sides of each fixing plate 51. In some embodiments, two second PCB boards 412 are fixed at both sides of each fixing plate 51, that is, each fixing plate 51 corresponds to four phase shifters 41 and two transmission assemblies 30.

In some embodiments, the phase shifter transmission device also includes the rack 60 connected to the gear assembly. The rack 60 directly restricts the rotation range of the gear assembly to restrict the rotation range of the transmission assembly 30, and ultimately prevents the phase range adjustment of the phase shifter from exceeding the preset range, which can play a role in mechanical protection. In addition, the rack also plays a role in zeroing phase of the phase shifter. In some embodiments, the rack 60 is arranged at the top end of the gear box 12, and its extension direction is perpendicular to the extension direction of the driving rod 20.

The working principle of the above embodiments is as below. The motor 11 drives the driving rod 20 to rotate through the gear assembly, and the driving rod 20 drives the plurality of transmission assemblies 30 connected thereto to rotate synchronously while rotating. The two driven gears 32 of each transmission assembly 30 rotate in the same direction, and each driven gear 32 drives the first PCB board 411 connected thereto to rotate while rotating. The rotation of the first PCB board 411 causes the coupling position of the first PCB board 411 and the second PCB board 412 to change, so that the phase shifter 41 changes the phase. Therefore, in the above embodiments, it is finally realized that one motor 11 drives the two-row phase shifters to synchronously change the phases in the same direction.

In some other embodiments, the phase shifters 41 can also be expanded to three or more rows. Correspondingly, each transmission assembly 30 increases the number of driven gears 32, that is, each transmission assembly 30 includes one driving gear 31 and three or more driven gears 32. Neighboring driven gears 32 of the multiple driven gears 32 are engaged with each other, and the driving gear 31 is engaged with two of the multiple driven gears 32 respectively at two sides of the driving gear 31. If the remaining driven gears 32 are located at the same side of the driving gear 31, the neighboring driven gears 32 of the remaining driven gears 32 on this side are engaged with each other; if the remaining driven gears 32 are located at two sides of the driving gear 31, the neighboring driven gears 32 at the same side are engaged with each other. Each driven gear 32 is correspondingly connected to one phase shifter 41, and three or more phase shifters 41 located in or nearly in the same column among the three or more rows of phase shifters are correspondingly connected to one transmission assembly 30, that is, they are driven by one transmission assembly 30 at the same time. Specifically, the two driven gears engaged with the driving gear rotate synchronously in the same direction. Also, among the multiple driven gears located at the same side of the driving gear, the first driven gear engaged with the driving gear and the $(2n+1)^{th}$ (such as the third, fifth, etc.) driven gear spaced apart from the first driven gear rotate synchronously in the same direction, thereby driving the phase shifters of the corresponding rows (such as the first row, the third row, . . . , the $(2n+1)^{th}$ row) to synchronously adjust the phases in the same direction. The second driven gear engaged with the first driven gear and the $(2n+2)^{th}$ (such as the fourth, sixth, etc.) driven gear spaced apart from the second driven gear rotate synchronously in the same direction, and rotate synchronously in opposite direction with the first driven gear, thereby driving the phase shifters of the corresponding rows (such as the second row, the fourth row, . . . , the $(2n+2)^{th}$ row) to synchronously adjust the phases in the opposite direction, so that the phase shifter of two adjacent rows (such as the first row and the second row, the third row and the fourth row, etc.) synchronously adjust the phases in the opposite direction, where n is an integer greater than or equal to 1.

The technical content and technical features of the present disclosure have been disclosed above, however, those skilled in the art may still make various substitutions and modifications based on the teaching and disclosure of the present disclosure without departing from the spirit of the present disclosure. Therefore, the protection scope of the present disclosure should not be limited to the content disclosed in the embodiments, but should include various substitutions and modifications that do not deviate from the present disclosure, which are covered by the claims of the present disclosure.

What is claimed is:

1. A phase shifter transmission device comprising:

a power mechanism;

a driving rod;

a plurality of transmission assemblies; and multiple rows of phase shifters;

wherein:

the power mechanism is connected to the driving rod and configured to drive the driving rod to rotate;

the plurality of transmission assemblies are connected to the driving rod, distributed along an axial direction of the driving rod, and driven by the driving rod to rotate synchronously;

each of the multiple rows of phase shifters includes a plurality of phase shifters distributed along the axial direction of the driving rod, and each phase shifter of each of the multiple rows of phase shifters is connected to the corresponding transmission assembly;

the multiple rows of phase shifters are configured, when being driven by the plurality of transmission assemblies, to synchronously adjust phases of radiated signals corresponding to the phase shifters;

each transmission assembly includes a driving gear connected to the driving rod and multiple driven gears, neighboring driven gears of the multiple driven gears are engaged with each other, and each of the multiple driven gears is correspondingly connected to one of the phase shifter; and the multiple driven gears are located at a same side of the driving gear, or the driving gear is engaged with two of the multiple driven gears located respectively at two sides of the driving gear.

2. The phase shifter transmission device of claim 1, wherein the multiple driven gears are located at a same side of the driving gear and the multiple driven gears comprise:

a first driven gear engaged with the driving gear and a $(2n+1)^{th}$ driven gear spaced apart from the first driven gear, configured to rotate synchronously in a first direction; and a second driven gear engaged with the first driven gear and a $(2n+2)^{th}$ driven gear spaced apart from the second driven gear, configured to rotate synchronously in a second direction, wherein the second direction is opposite to the first direction, and n is an integer greater than or equal to 1.

3. The phase shifter transmission device of claim 2, wherein each phase shifter includes a first PCB board and a second PCB board that are coupled to each other, the first PCB board is fixedly connected to the driven gear and rotates synchronously with the driven gear corresponding to the phase shifter.

4. The phase shifter transmission device of claim 3, wherein the first PCB board and the driven gear are fixedly connected through a clamping block and a slot that match with each other, the clamping block is clamped into the slot.

5. The phase shifter transmission device of claim 3, further comprising a plurality of fixing plates, the second PCB board is fixed to a corresponding one of the plurality of fixing plates.

6. The phase shifter transmission device of claim 1, wherein the driving gear is engaged with two of the multiple driven gears located respectively at two sides of the driving gear, the two driven gears engaged with the driving gear are configured to rotate synchronously in a first direction, and the multiple driven gears located at a same side of the driving gear comprise:

a first driven gear engaged with the driving gear and a $(2n+1)^{th}$ driven gear spaced apart from the first driven gear, configured to rotate synchronously in the first direction; and a second driven gear engaged with the first driven gear and a $(2n+2)^{th}$ driven gear spaced apart from the second driven gear, configured to rotate synchronously in a second direction, wherein the second direction is opposite to the first direction, and n is an integer greater than or equal to 1.

7. The phase shifter transmission device of claim 6, wherein each phase shifter includes a first PCB board and a second PCB board that are coupled to each other, the first PCB board is fixedly connected to the driven gear and rotates synchronously with the driven gear corresponding to the phase shifter.

8. The phase shifter transmission device of claim 7, wherein the first PCB board and the driven gear are fixedly connected through a clamping block and a slot that match with each other, the clamping block is clamped into the slot.

9. The phase shifter transmission device of claim 7, further comprising a plurality of fixing plates, the second PCB board is fixed to a corresponding one of the plurality of fixing plates.

10. The phase shifter transmission device of claim 1, wherein the multiple driven gears are located at a same side of the driving gear and each phase shifter includes a first PCB board and a second PCB board that are coupled to each other, the first PCB board is fixedly connected to the driven gear and rotates synchronously with the driven gear corresponding to the phase shifter.

11. The phase shifter transmission device of claim 10, wherein the first PCB board and the driven gear are fixedly connected through a clamping block and a slot that match with each other, the clamping block is clamped into the slot.

12. The phase shifter transmission device of claim 10, further comprising a plurality of fixing plates, the second PCB board is fixed to a corresponding one of the plurality of fixing plates.

13. The phase shifter transmission device of claim 1, wherein the driving gear is engaged with two of the multiple driven gears located respectively at two sides of the driving gear, each phase shifter includes a first PCB board and a second PCB board that are coupled to each other, the first PCB board is fixedly connected to the driven gear and rotates synchronously with the driven gear corresponding to the phase shifter.

14. The phase shifter transmission device of claim 13, wherein the first PCB board and the driven gear are fixedly connected through a clamping block and a slot that match with each other, the clamping block is clamped into the slot.

15. The phase shifter transmission device of claim 13, further comprising a plurality of fixing plates, the second PCB board is fixed to a corresponding one of the plurality of fixing plates.

16. The phase shifter transmission device of claim 1, further comprising a rack connected to the power mechanism.

* * * * *